United States Patent [19]

Ehrich

[11] Patent Number: 4,793,018

[45] Date of Patent: Dec. 27, 1988

[54] TENNIS SHOE CLEANING DEVICE

[76] Inventor: James D. Ehrich, Suite 12, 12875 S. Cleveland Ave., Fort Myers, Fla. 33907

[21] Appl. No.: 927,903

[22] Filed: Nov. 6, 1986

[51] Int. Cl.[4] ..... A47L 23/22; B08B 3/02

[52] U.S. Cl. ..... 15/104.92; 15/238; 134/184; 134/201

[58] Field of Search ..... 15/104.92, 215, 216, 15/217, 161, 238, 237, 104.93, 104.94; 134/201, 182, 184, 196

[56] References Cited

U.S. PATENT DOCUMENTS

| | | | |
|---|---|---|---|
| 2,282,672 | 5/1942 | Nelsons | 15/215 |
| 2,604,377 | 7/1952 | Eames | 15/104.92 |
| 3,300,275 | 1/1967 | Lorman | 15/215 |
| 3,696,459 | 10/1972 | Kucera et al. | 15/104.92 |
| 4,047,259 | 9/1977 | Lotis | 15/104.92 |
| 4,280,729 | 7/1981 | Morawski | 15/215 |

FOREIGN PATENT DOCUMENTS

| | | | |
|---|---|---|---|
| 1442570 | 7/1976 | United Kingdom | 15/104.92 |

*Primary Examiner*—Harvey C. Hornsby
*Assistant Examiner*—Joseph S. Machuga
*Attorney, Agent, or Firm*—James D. Hall

[57] ABSTRACT

A shoe cleaning device which includes a mat positioned within a pan of cleaning fluid, the mat is of pliable open cellular construction wich allows the fluid to be coursed into sole crevices to effect cleaning thereof when the mat is stepped on.

1 Claim, 3 Drawing Sheets

TENNIS SHOE CLEANING DEVICE

SUMMARY OF THE INVENTION

This invention relates to a cleaning device and will have special but not limited application to a portable player-activated device for cleaning the crevices in tennis shoe soles.

Clay based tennis courts have in recent years become popular both in the United States and abroad due to ease in maintenance and their ability to withstand changes in weather conditions. Unfortunately for the clay court tennis player, the loose particles of surface clay tend to collect in the crevices of the shoe sole, which necessitate immediate cleaning of the sole after a match.

The shoe cleaning device of this invention includes a water filled pan in which is positioned an open cell cleaning mat having a plurality of holes in its upper surface. As a player steps onto the mat, water is forced through the holes and up into the sole crevices to wash the clay particles from within while at the same time preventing water from contacting the leather or canvas shoe uppers.

Accordingly, it is an object of this invention to provide a device which is for cleaning clay deposits from the crevices of a tennis shoe sole.

Another object of this invention is to provide for a shoe sole cleaning device which protects the shoe uppers from water damage during cleaning.

Another object of this invention is to provide for a shoe sole cleaning device which is actuated by the shoe wearer.

Still another object of this invention is to provide for a portable shoe sole cleaning device which is efficient and economical.

Other objects of this invention will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 1:
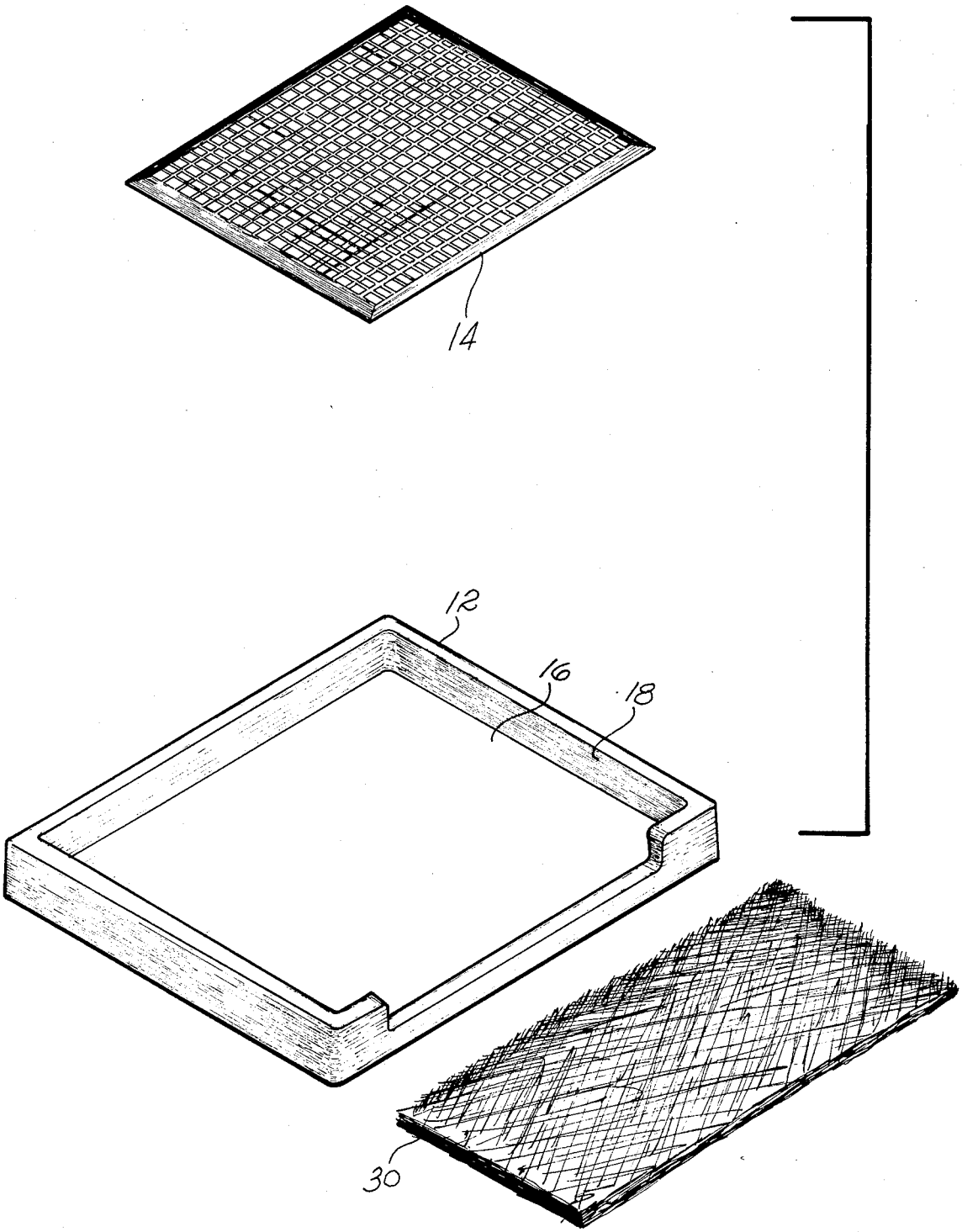
FIG. 1 is an exploded view of the shoe sole cleaning device.
Figure 2:
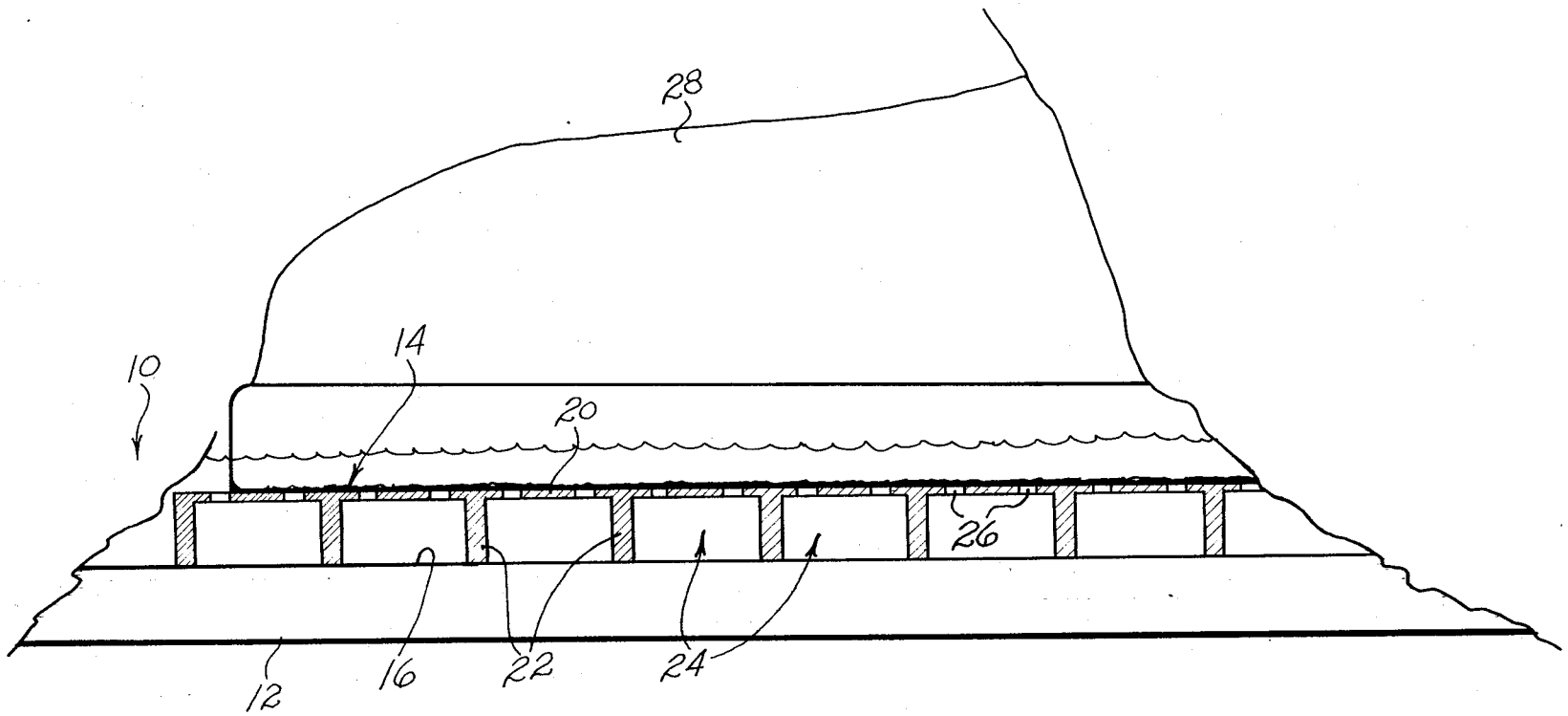
FIG. 2 is a sectional view of the device taken just prior to shoe contact with the cleaning mat.
Figure 3:
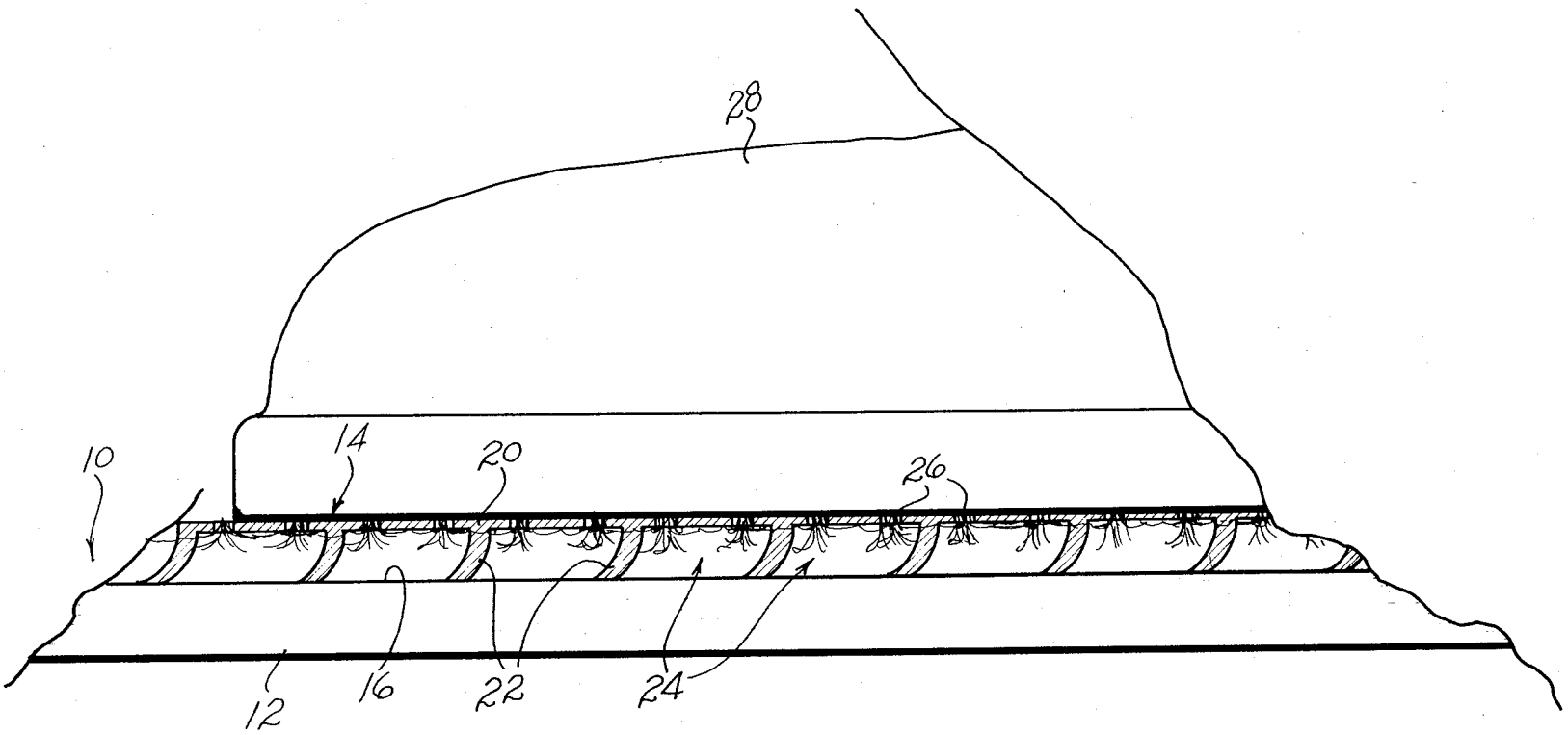
FIG. 3 is a sectional view of the device taken just after shoe contact.

Referring now to the drawings, the reference numeral 10 refers generally to the shoe sole cleaning device of this invention. Device 10 generally includes a pan 12 and a cleaning mat 14 positioned within the pan. Pan 12 may be formed of any suitable rigid or semi-rigid material such as metal or plastic and is formed by a bottom wall 16 and a continuous integral peripheral lip 18. Mat 14 is preferably of the partially open cellular construction shown in FIG. 3 and includes a top wall 20 and a plurality of integral downturned intersticed ribs 22 which form individual compartments 24 below the mat top wall. Mat 14 is formed of pliable, shape-returning material such as natural or synthetic rubber or the like. Top wall 20 has at least one and preferably a plurality of holes 26 therethrough into each compartment 24 as seen in FIGS. 2–3.

In use, mat 14 is positioned in pan 12 and the pan is filled with a cleaning fluid (usually water) to a level just above such as ¼ inch above the mat top wall 20. After a tennis player has finished his practice or match, the player steps into pan 12 onto mat top wall 20. The player's weight combined with the flexible nature of mat 14 urges mat top wall 20 downward towards pan bottom wall 16 and which decreases volume of compartments 24 and causes the fluid in each compartment to course or squirt through holes 26 in the mat top wall in a forceful manner into tennis shoe sole crevices (not shown) to clean out the clay particles. The player may then dry his shoes 28 by rubbing the soles across a mat 30 formed of straw or similar material.

It is understood that the invention is not limited to the details abovegiven, but may be modified within the scope of the following claims.

I claim:

1. A device for cleaning loose particles from sole crevices of a shoe, said device comprising a receptacle at least partially filled with a quantity of fluid, a flexible mat formed of pliable shape-returning material positioned within said receptacle, said mat including storage means for holding a portion of said fluid, said mat constituting means for expelling said fluid from said storage means under pressure into said shoe sole crevices to clean the loose particles from therein when the mat is stepped on and flexed by a wearer of said shoe, said storage means including a top wall and a plurality of pliable intersticed depending ribs extending from said top wall to adjacent said receptacle to form individual peripherally enclosed independent compartments, said storage means top wall having a plurality of holes therethrough extending into said compartments to accommodate expulsion of fluid from said compartments when said mat is so stepped upon.

* * * * *